US009348289B2

(12) United States Patent
Obata

(10) Patent No.: US 9,348,289 B2
(45) Date of Patent: May 24, 2016

(54) IMAGE FORMING APPARATUS TO CONTROL RECORDING MATERIAL FEEDING BASED ON WHEN AN IMAGE IS FORMED ON AN IMAGE BEARING MEMBER

(71) Applicant: CANON KABUSHIKI KAISHA, Tokyo (JP)

(72) Inventor: Naohiro Obata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/971,649

(22) Filed: Aug. 20, 2013

(65) Prior Publication Data

US 2014/0056629 A1 Feb. 27, 2014

(30) Foreign Application Priority Data

Aug. 24, 2012 (JP) ..... 2012-185719

(51) Int. Cl.
*G03G 15/00* (2006.01)

(52) U.S. Cl.
CPC ..... *G03G 15/6529* (2013.01); *G03G 15/6558* (2013.01); *G03G 2215/00599* (2013.01); *G03G 2215/00734* (2013.01)

(58) Field of Classification Search
CPC ..... G03G 2215/00734; G03G 15/5029; G03G 15/00734; G03G 15/6529; G03G 15/6558; G03G 15/00599
USPC ..... 399/45, 389, 388
See application file for complete search history.

(56) References Cited

U.S. PATENT DOCUMENTS

| | | | | |
|---|---|---|---|---|
| 5,221,949 | A * | 6/1993 | Miyamoto | 399/389 |
| 5,812,923 | A * | 9/1998 | Yamauchi et al. | 399/388 |
| 6,253,039 | B1 * | 6/2001 | Nakano et al. | 399/53 |
| 6,421,139 | B1 * | 7/2002 | Takami et al. | 358/1.2 |
| 7,113,715 | B2 * | 9/2006 | Yang et al. | 399/66 |
| 7,715,739 | B2 * | 5/2010 | Umeda et al. | 399/45 |
| 7,912,384 | B2 * | 3/2011 | Dan | 399/16 |
| 8,060,003 | B2 * | 11/2011 | Yoshizawa | 399/396 |
| 2004/0126128 | A1 * | 7/2004 | Shibata | 399/82 |
| 2009/0034993 | A1 * | 2/2009 | Son et al. | 399/18 |
| 2012/0014730 | A1 * | 1/2012 | Yoshizawa | 399/389 |

FOREIGN PATENT DOCUMENTS

| | | | |
|---|---|---|---|
| JP | 2001-341899 | A | 12/2001 |
| JP | 2002-154682 | A | 5/2002 |
| JP | 2008-122935 | A | 5/2008 |
| JP | 2012-212173 | A | 11/2012 |

* cited by examiner

*Primary Examiner* — Clayton E LaBalle
*Assistant Examiner* — Trevor J Bervik
(74) *Attorney, Agent, or Firm* — Canon USA, Inc. IP Division

(57) ABSTRACT

An image forming apparatus, which forms an image at an image forming interval and feeding timing corresponding to a predetermined recording material size, includes a control unit (a controller unit and an engine control unit) for controlling the feeding timing to be earlier, when the size of a recording material detected by a detection unit (the engine control unit and an registration sensor) is smaller than the predetermined recording material size.

10 Claims, 12 Drawing Sheets

TIME FROM STOPPING AND TO RESTARTING PAPER FEEDING

IMAGE FORMING APPARATUS TO CONTROL RECORDING MATERIAL FEEDING BASED ON WHEN AN IMAGE IS FORMED ON AN IMAGE BEARING MEMBER

BACKGROUND OF THE INVENTION

1. Field of the Invention

The present invention relates to an image forming apparatus, such as a copying machine and a printer, having a function of forming an image on a recording material such as a sheet.

2. Description of the Related Art

Conventionally, as an image forming apparatus such as a copying machine and a laser beam printer, an image forming apparatus using an intermediate transfer member is known. In such image forming apparatus, a plurality of photosensitive drums is arranged in parallel in contact with the intermediate transfer member, and a primary transfer process and a secondary transfer process form a color image (multicolor image) on a recording material.

In the primary transfer process, a toner image formed on a surface of the photosensitive drum is transferred onto the intermediate transfer member. The primary transfer process is performed on each of toner images in a plurality of colors to superimpose and transfer the toner images therein onto the surface of the intermediate transfer member. In the secondary transfer process to be sequentially performed, the toner images in the plurality of colors formed on the surface of intermediate transfer member are collectively transferred at a secondary transfer position onto a surface of the recording material fed from a cassette. At this point, after the recording material fed from the cassette temporarily waits at a predetermined position just before the secondary transfer position, it is re-fed in association with the timing when the toner image on the intermediate transfer member reaches the secondary transfer position.

To reduce a production cost, some image forming apparatuses do not provide a recording material size detection mechanism for cassettes.

In this case, as performing a print operation, an image forming apparatus detects an actual length of a recording material (hereinafter, referred to as a "recording material length") in a conveyance direction of the recording material. After the detection, based on the detection result of the length of the recording material, the print operation is controlled. More specifically, for example, Japanese Patent Application Laid-Open No. 2008-122935 discusses the image forming apparatus in which the print operation is performed at an image forming interval and a paper feeding interval of the recording material appropriate for the detection result of the length of the recording material.

For the image forming apparatus, a throughput is generally defined based on an A4 size (referred to as "A4", hereinafter) in a product catalog, and, in some cases, even for the A4 or smaller recording material, the throughput may be designed not to exceed (to be the same as) the throughput for A4 sheet printing. Therefore, when the printing is performed on the recording material smaller than A4, it is performed with the same throughput as that for A4. The throughput herein refers to the number of images to be formed per unit time.

As described above, print control is performed in an order of feeding, stopping, and re-feeding the recording material. In the control, a required time from starting to feed to starting to re-feed the recording material may be extended. Its cause may be slip of the recording material in a paper feeding operation when the recording material is being fed, and a conveyance trouble due to abrasion of a roller for conveying the recording material. In consideration of delay of the conveyance of the recording material due to various types of causes, if the feeding is started earlier before re-feeding timing, even if the delay occurs, the recording material can be possibly conveyed in time. When the small-size recording material is specified, as described above, the control is conventionally performed with the throughput equivalent to that for A4. In other words, the image is formed at the same image forming interval as that for A4 sheet printing and, according to the image forming interval, the feeding interval is determined. As a result, the paper-feeding timing is the same as that for A4 sheet printing. In other words, for example, for A5 size (referred to as "A5", hereinafter) sheet printing, a subsequent recording material is not fed right after a previous recording material has been fed, but the recording material is fed after the A4 interval has elapsed. Thus, the feeding timing is delayed for the size of the recording material.

SUMMARY OF THE INVENTION

The present invention is directed to an image forming apparatus in which feeding performance of a recording material is improved when an image is formed on the recording material in a smaller size than that of the recording material corresponding to an image-forming interval that has been previously set.

According to an aspect of the present invention, an image forming apparatus includes a toner image forming unit for forming a toner image on an image bearing member according to an image forming instruction, a transfer unit for transferring the toner image, which is formed on the image bearing member by the toner image forming unit, onto a recording material at a transfer portion, a feeding unit for feeding the recording material placed on a placement unit, a re-feeding unit for stopping the recording material fed by the feeding unit and for feeding the recording material to the transfer portion in synchronization with timing when the toner image formed on the image bearing member by the toner image forming unit reaches the transfer portion, a detection unit for detecting a size of the recording material placed on the placement unit and to be fed by the feeding unit, wherein an image is formed at an image forming interval and feeding timing corresponding to a predetermined recording material size, and a control unit configured to, when the size of the recording material detected by the detection unit is smaller than the predetermined recording material size, control the feeding timing to be earlier.

According to another aspect of the present invention, an image forming apparatus includes a toner image forming unit for forming a toner image on an image bearing member according to an image forming instruction, a transfer unit for transferring the toner image, which is formed on the image bearing member by the toner image forming unit, onto a recording material at a transfer portion, a feeding unit for feeding the recording material placed on a placement unit, a re-feeding unit for stopping the recording material fed by the feeding unit and for feeding the recording material to the transfer portion in synchronization with timing when the toner image formed on the image bearing member by the toner image forming unit reaches the transfer portion, a specification unit for specifying a recording material size, and a detection unit for detecting a size of the recording material placed on the placement unit and to be fed by the feeding unit, wherein an image is formed at an image forming interval and feeding timing corresponding to the recording material size specified by the specification unit, and a control unit configured to, when the size of the recording material detected by the detection unit is smaller than the recording material size specified by the specification unit, control the feeding timing to be earlier.

Further features of the present invention will become apparent from the following description of exemplary embodiments with reference to the attached drawings.

DESCRIPTION OF THE EMBODIMENTS

Exemplary embodiments of the present invention will be described in detail with reference to the drawings. However, dimensions, materials, forms, and relative arrangement of components described in the present exemplary embodiments are to be appropriately changed depending on the configuration of the apparatus to which the exemplary embodiments of the present the invention is applied, and various conditions. In other words, they are not intended to limit a scope of the present invention to the exemplary embodiment described below.

Figure 1:
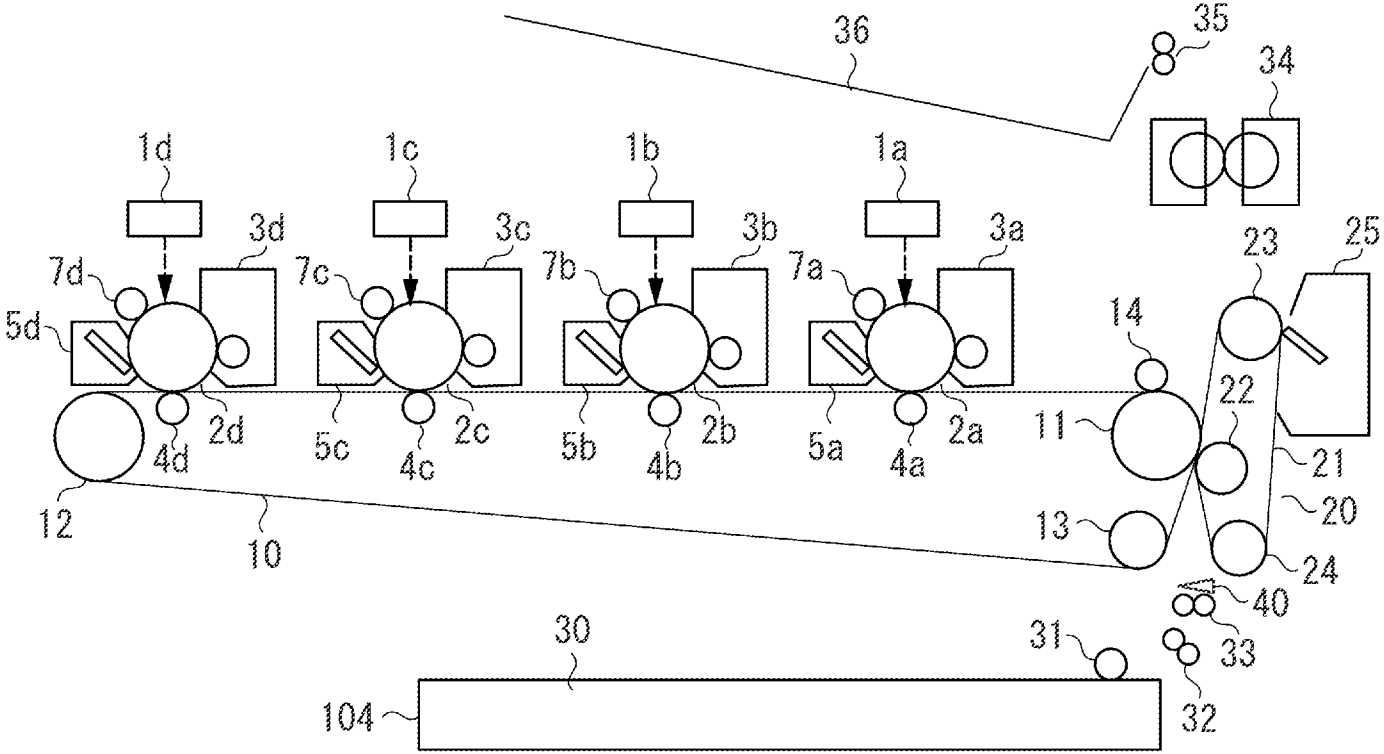
FIG. 1 is a cross-sectional view illustrating a schematic configuration of an image forming apparatus according to a first exemplary embodiment.

A first exemplary embodiment will be described below. FIG. 1 is a cross-sectional view illustrating a schematic configuration of an image forming apparatus according to the present exemplary embodiment.

In the image forming apparatus according to the present exemplary embodiment, as illustrated in FIG. 1, four electrophotographic photosensitive drums (referred to as "photosensitive drums", hereinafter) 2*a*, 2*b*, 2*c*, and 2*d* provided for respective stations in yellow, magenta, cyan, and black are arranged in parallel.

In a periphery of each photosensitive drum, in order from an upper-stream side in a rotational direction thereof, first charging devices 7*a*, 7*b*, 7*c*, and 7*d*, development units 3*a*, 3*b*, 3*c*, and 3*d*, an intermediate transfer belt 10, primary transfer units 4*a*, 4*b*, 4*c*, and 4*d*, and cleaning units 5*a*, 5*b*, 5*c*, and 5*d* are disposed.

The first charging devices 7*a*, 7*b*, 7*c*, and 7*d* are charging units for uniformly charging each surface of the photosensitive drums 2*a*, 2*b*, 2*c*, and 2*d*. The surfaces of the photosensitive drums 2*a*, 2*b*, 2*c*, and 2*d* uniformly charged by the first charging devices 7*a*, 7*b*, 7*c*, and 7*d* are irradiated with laser beams by exposure units 1*a*, 1*b*, 1*c*, and 1*d* based on image information to form electrostatic latent images. The intermediate transfer belt 10 corresponds to an image bearing member. Further, the photosensitive drums 2*a*, 2*b*, 2*c*, and 2*d*, the first charging devices 7*a*, 7*b*, 7*c*, and 7*d*, the exposure units 1*a*, 1*b*, 1*c*, and 1*d*, the development units 3*a*, 3*b*, 3*c*, and 3*d*, and the primary transfer units 4*a*, 4*b*, 4*c*, and 4*d* correspond to a toner-image forming unit.

Each station has substantially the same configuration and operation except for using toner in different colors. Therefore, when no specific discrimination is required in description below, additional letters "a", "b", "c", and "d" given to reference symbols to express for which color a component is provided are omitted, and the station is collectively described.

A development unit 3 makes toner (developer) in each color adhere onto the surface of a photosensitive drum 2, and the electrostatic latent image formed thereon is visualized as a toner image. A cleaning unit 5 removes the toner remaining on the surface of the photosensitive drum 2 after transfer has been performed.

At a position facing the photosensitive drum 2, the intermediate transfer belt (intermediate transfer member) 10, onto which the toner image formed on the surface of the photosensitive drum 2 is to be primary-transferred, is stretched by a driving roller 11, a tension roller 12, and a driven roller 13.

The intermediate transfer belt 10 is disposed with a remaining toner charging roller 14 for charging remaining toner adhering onto the intermediate transfer belt 10. The remaining toner charging roller 14 charges secondary transfer remaining toner remaining on the intermediate transfer belt 10 after secondary transfer has been finished. The secondary transfer remaining toner charged by the remaining toner charging roller 14 is moved to an image forming station while being kept staying on the intermediate transfer belt 10, inversely transferred onto the photosensitive drum 2, and then collected by the cleaning unit 5.

A secondary transfer device 20 is disposed at a position facing a driving roller 11 having the intermediate transfer belt 10 therebetween. In the secondary transfer device 20, a secondary transfer belt 21 is stretched by a secondary transfer driving roller 23, a secondary transfer tension roller 24, and a secondary transfer roller 22. The secondary transfer roller 22 is disposed at a position facing the driving roller 11 having the intermediate transfer belt 10 and the secondary transfer belt 21 therebetween. A contact portion (secondary transfer nip) between the intermediate transfer belt 10 and the secondary transfer belt 21, which come into contact with each other when the secondary transfer roller 22 and the driving roller 11 are disposed facing with each other, corresponds to a transfer portion.

Further, at a position facing the secondary transfer driving roller 23, a secondary transfer cleaning unit 25 of a resin blade method for removing the toner adhering onto the secondary transfer belt 21 is disposed.

The toner image formed on each photosensitive drum 2 is primary-transferred onto the intermediate transfer belt 10 by an operation of each primary transfer unit 4. On the other hand, recording materials 30, which is fed out by a pick-up roller 31 serving as a feeding unit from the feeding cassette 104 serving as a placement unit, is separated and fed by a separation unit (not illustrated) piece by piece.

Subsequently, the recording material 30 is fed to a registration roller pair 33 by a conveyance roller pair 32, a conveyance operation is stopped by the registration roller pair 33, and then the recording material 30 is conveyed to the secondary transfer belt 21 at a predetermined timing. The registration roller pair 33 corresponds to a re-feeding unit, which is provided such that the recording material fed by the pick-up roller 31 can be stopped and feeds the recording material to the secondary transfer nip in synchronization with the timing when the toner image formed on the intermediate transfer belt 10 reaches the secondary transfer nip.

Further, in a state where the recording material is electrostatically attracted onto the secondary transfer belt 21, the recording material is conveyed to the secondary transfer nip between the intermediate transfer belt 10 and the secondary transfer belt 21. The toner image primary-transferred onto the intermediate transfer belt 10 is secondary-transferred onto the recording material 30 by an operation of the secondary transfer roller 22 at the secondary transfer nip. After the toner image is fixed by a fixing unit 34, the recording material 30 on which the toner image is transferred is conveyed by a discharging roller pair 35, and then discharged onto a discharge tray 36 provided at an upper portion of an apparatus main body.

Figure 2A:
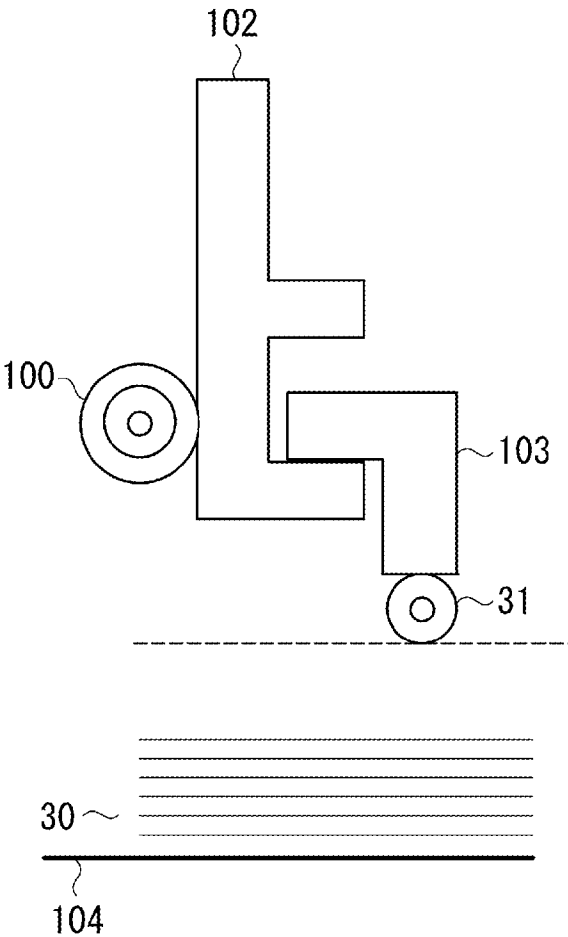
FIGS. 2A and 2B are schematic diagrams illustrating a feeding mechanism provided for the image forming apparatus according to the first exemplary embodiment.
Figure 2B:
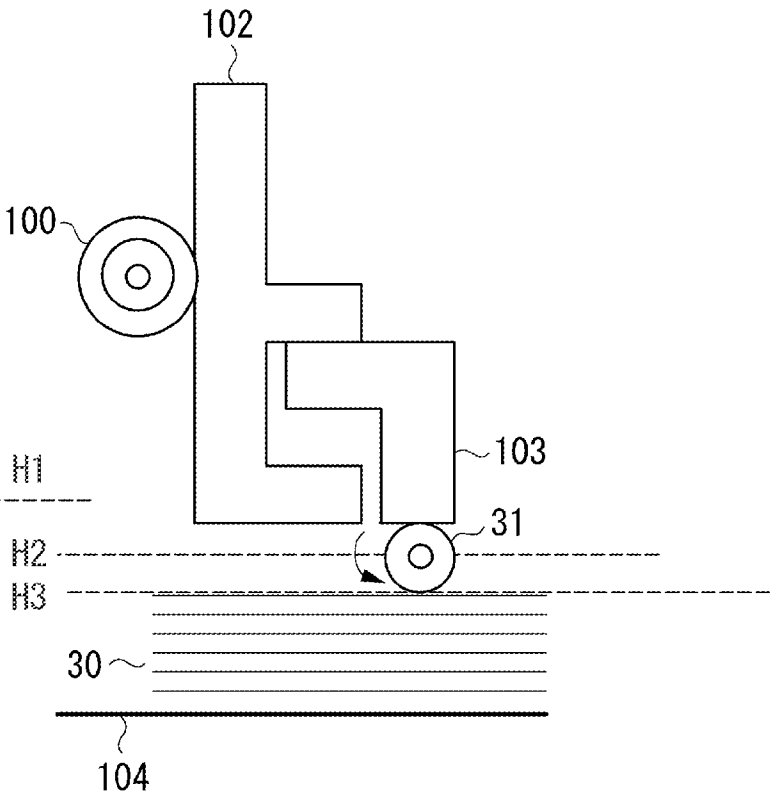

FIGS. 2A and 2B are schematic diagrams illustrating a feeding mechanism included in the image forming apparatus.

A gear 100 drives a rack and pinion 102 up and down, and is rotated by driving of a stepping motor (not illustrated). When a rotational direction of the stepping motor is switched between forward rotation and inverted rotation, driving of the rack and pinion 102 is switched between an upper direction and a lower direction. A feeding unit 103 and the pick-up roller 31 connected therewith drive up and down along with the up and down driving of the rack and pinion 102.

As illustrated in FIG. 2A, before the feeding is performed, the pick-up roller 31 is disposed at a position H1 higher than the position of the uppermost recording material 30 stacked on the feeding cassette 104.

As illustrated in FIG. 2B, when the feeding is performed, the gear 100 is rotated and, until the pick-up roller 31 comes into contact with the surface of the uppermost recording material 30 disposed, the rack and pinion 102 and the feeding unit 103 are moved down. Subsequently, by a motor having a driving source different from that of the stepping motor of the gear 100, the pick-up roller 31 is rotated by a predetermined amount in a direction indicated by the arrow illustrated in FIG. 2B and then the recording material 30 is fed piece by piece. After the feeding has been completed, the rotational direction of the stepping motor is changed into an opposite direction. The gear 100 is rotated in the opposite direction to move up the rack and pinion 102 and the feeding unit 103, and then the pick-up roller 31 returns to the position H1.

Figure 3:
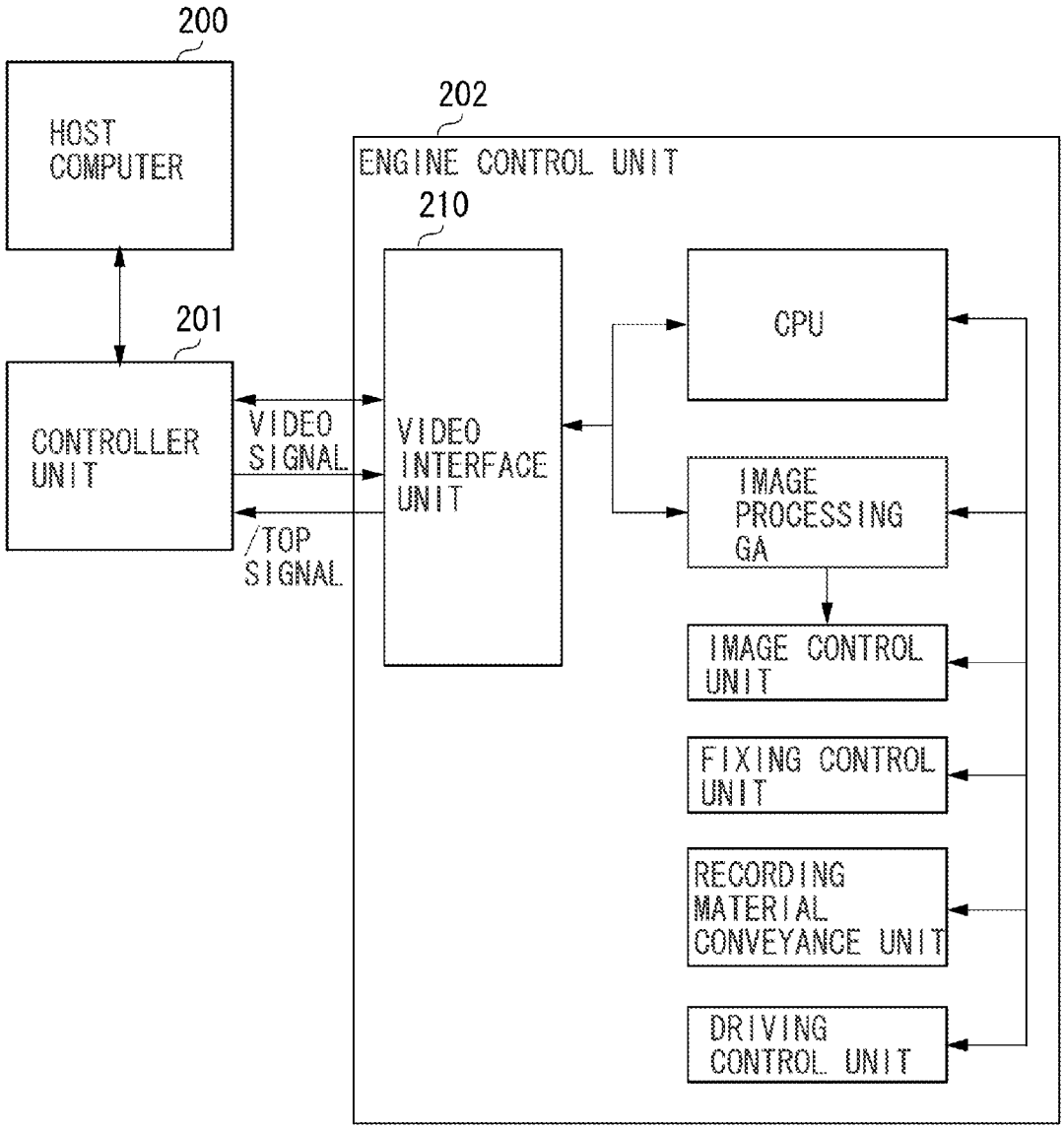
FIG. 3 is a block diagram illustrating a system configuration of the image forming apparatus according to the first exemplary embodiment.

FIG. 3 is a block diagram illustrating a system configuration of the image forming apparatus.

A controller unit 201 can mutually communicate with a host computer 200 and an engine control unit 202. The controller unit 201 receives image information and a print order from the host computer 200, and analyzes the received image information to convert it into bit data. The controller unit 201 transmits a print reservation command, a print starting command, and a video signal to the engine control unit 202 for each recording material via a video interface unit 210. The controller unit 201 and the engine control unit 202 constitute a control unit.

The controller unit 201 transmits to the engine control unit 202 the print reservation command according to the print order from the host computer 200 and, at the timing when printing can be performed, transmits the print starting command to the engine control unit 202. Further, the controller unit 201 transmits to the engine control unit 202 print ratio information about a print image prior to the print starting command.

The engine control unit 202 prepares for performing printing according to an order of the print reservation commands from the controller unit 201 and waits for the print starting commands from the control unit 201. Upon reception of the print instruction, the engine control unit 202 outputs a /TOP signal (image forming instruction), which becomes reference timing of an output of the video signal, to the controller unit 201 and then starts a feeding operation.

The registration roller pair 33 stops rotation, and the fed recording material is set to be in a suspension state. Subsequently, in synchronization with the timing when the toner image formed on the intermediate transfer belt 10 reaches the secondary transfer nip, the recording material is re-fed by the registration roller pair 33.

Figure 4A:
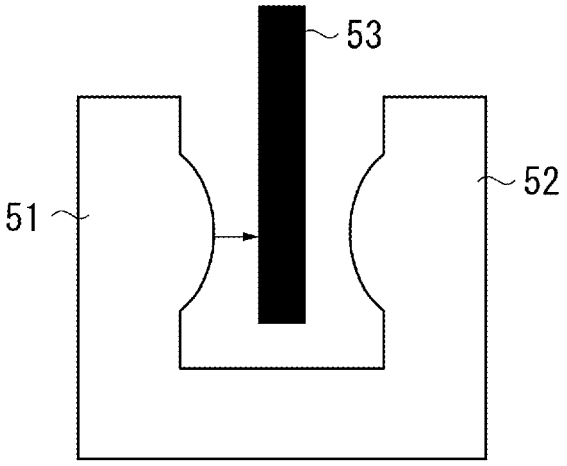
FIGS. 4A, 4B, 4C, and 4D illustrate a mechanical mechanism of a registration sensor and a mechanism of its operation according to the first exemplary embodiment.
Figure 4B:
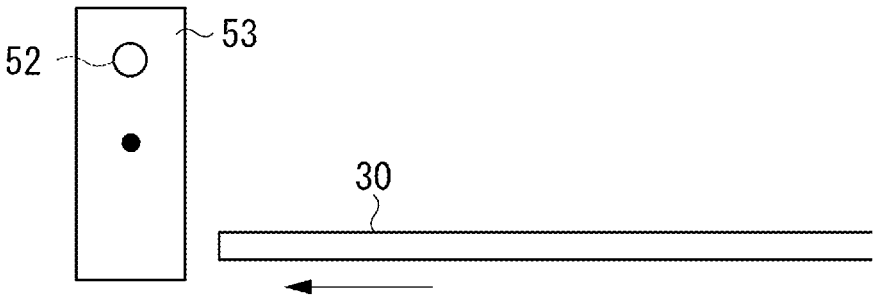
Figure 4C:
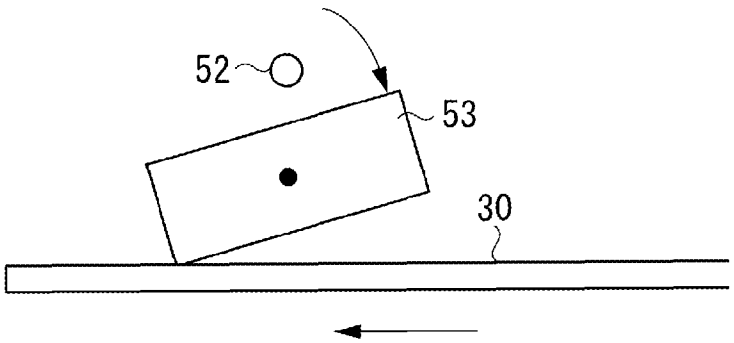
Figure 4D:
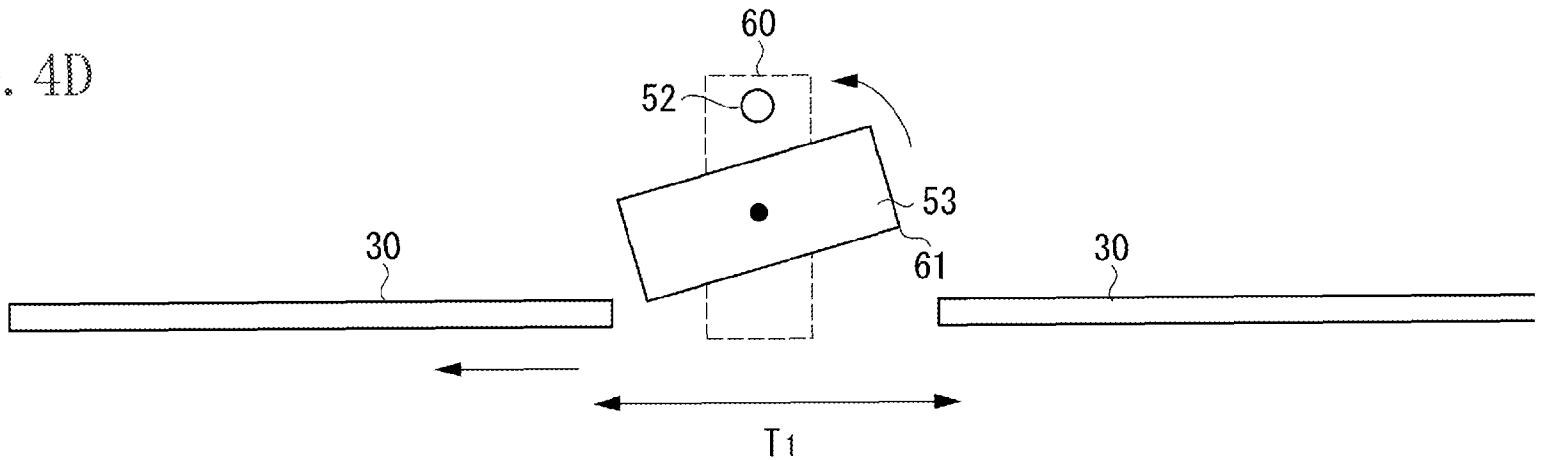

FIGS. 4A, 4B, 4C, and 4D are schematic diagrams illustrating a mechanical mechanism of a registration sensor 40 and a mechanism of its operations. FIG. 4A is a schematic sectional-view illustrating the registration sensor 40. FIGS. 4B, 4C, and 4D illustrate operations when the recording material 30 is detected by the registration sensor 40.

A photo interrupter is applied to the registration sensor 40 and, as illustrated in FIG. 4A, the registration sensor 40 includes a light-emitting portion 51 and a light-receiving portion 52 that face each other. As illustrated in FIG. 4B, a mechanical flag 53 generally shuts light. When the recording material is passing through the registration sensor 40, as illustrated in FIG. 4C, the mechanical flag 53 is pushed by the recording material, and thus the recording material can be detected when the light emitted from the light-emitting portion 51 reaches the light-receiving portion 52.

When the recording material 30 reaches the registration sensor 40, the mechanical flag 53 is pushed by the recording material 30 to be set in a state illustrated in FIG. 4C. As a result, the light from the light-emitting portion 51 reaches the light-receiving portion 52, and then the recording material can be detected. Subsequently, as illustrated in FIG. 4D, due to a configuration of the sensor, the recording material is detected after the recording material 30 has passed through the registration sensor 40 and before the mechanical flag 53 returns to a position 60 indicated by a dotted line. Therefore, in order for the registration sensor 40 to detect each of a plurality of recording materials passing therethrough, conveyance of each recording material needs to be controlled in consideration of a time until the mechanical flag 53 returns to the position 60.

Figure 5:
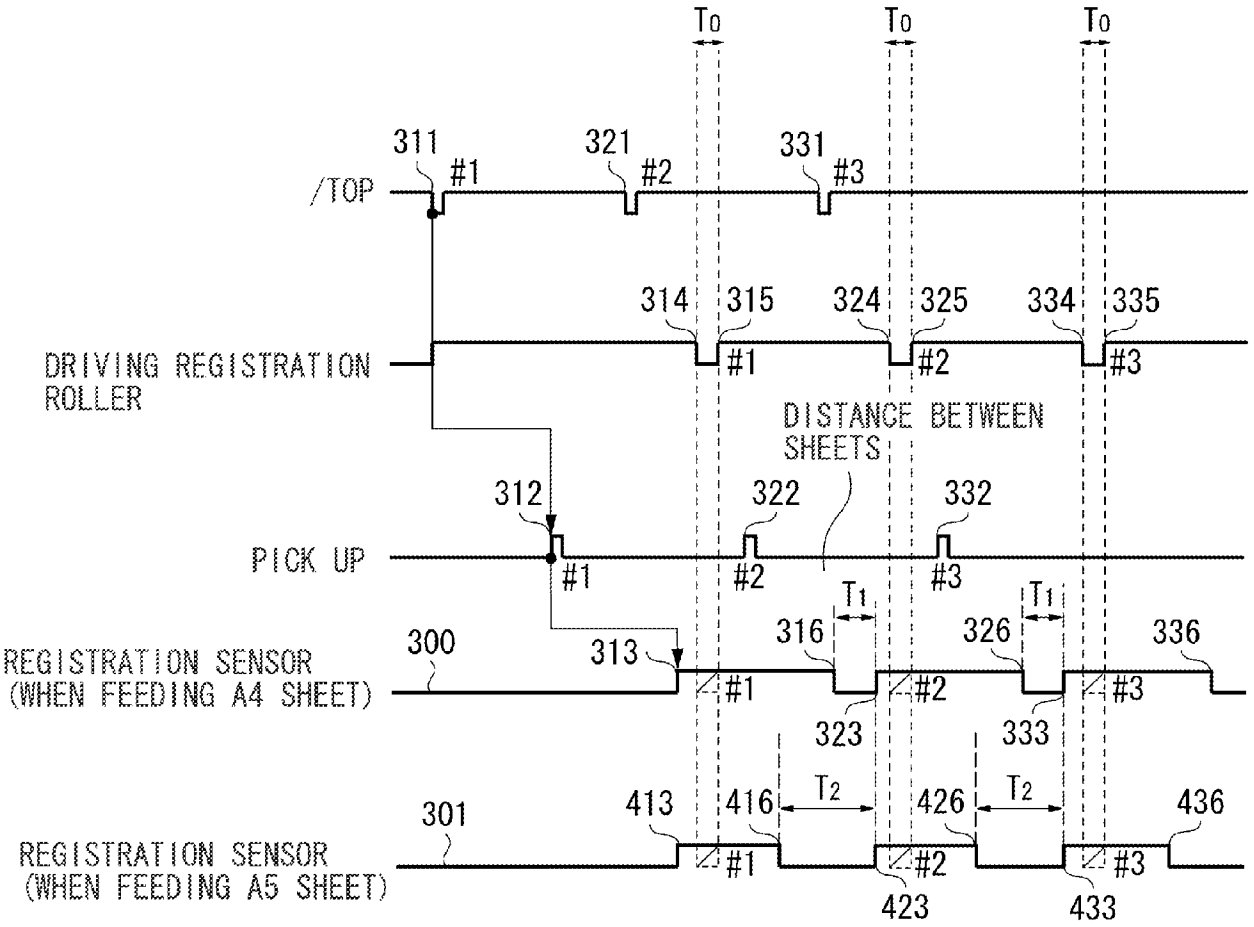
FIG. 5 is a timing chart for printing under conventional control.

FIG. 5 is a timing chart for printing by conventional control. Timing chart 300 indicates the operation of the registration sensor 40 when sequential printing is performed on an A4 recording material. Timing chart 301 indicates the operation of the registration sensor 40 when printing is performed on the small-size recording material. According to the present exemplary embodiment, the small size is defined as A5 for descriptions.

First, a print operation of the A4 recording material will be described.

Upon reception of a print starting command from the controller unit 201, at timing 311, the engine control unit 202 starts print preparation (pre-rotation operation). When printing is prepared, the /TOP signal is output to start to form an image on the intermediate transfer belt 10.

After the engine control unit 202 outputs the /TOP signal at the timing 311, when a predetermined time has elapsed, at timing 312, a feeding operation is started. With reference to timing 313 when the fed recording material reaches the registration sensor 40, at timing 314, the recording material is stopped with a leading edge of the recording material positioned at a predetermined position (hereinafter, referred to as a "suspension position") between the registration sensor 40 and the secondary transfer roller 22.

Subsequently, at timing 315, corresponding to the image formed on the intermediate transfer belt 10, the engine control unit 202 resumes conveyance of the recording material, and transfers the toner image on the intermediate transfer belt 10 onto a desired position of the recording material.

When sequential printing is performed, the engine control unit 202 outputs the /TOP signal to satisfy two conditions described below.

(1) The trailing edge and the leading edge of the recording materials to be sequentially conveyed can be detected by the registration sensor 40.

(2) The fed recording material has reached the suspension position by re-feeding timing.

Of the above-described conditions, the condition (1) can be determined by tolerance of the mechanical flag as described with reference to FIGS. 4A, 4B, 4C, and 4D (time T1 when the mechanical flag can return to a predetermined position (refer to FIGS. 4A, 4B, 4C, and 4D, and 5) is ensured). The condition (2) is greatly influenced by external causes such as quality of the recording material and the abrasion of the roller.

When the fed recording material cannot reach the suspension position by the re-feeding timing due to such influence, the toner image cannot be transferred onto the desired position of the recording material, thereby generating misprint caused by a conveyance problem (normal printing cannot be performed).

Therefore, when the sequential printing is performed, the longer the time from feeding to re-feeding the recording material is, the less likely the misprint occurs (conveyance margin is larger). It means that the longer the time from feeding to re-feeding the recording material is, the longer waiting time T0 (refer to FIG. 5) from stopping to restarting feeding becomes. Generally, a time from feeding to re-feeding the recording material is set, based on the recording material (A4 according to the present exemplary embodiment) for which the through put is defined, to a minimum interval so that the recording material can be conveyed in time, even though the slip caused depending on a type of the recording material or the abrasion of the roller may occur.

Subsequently, a print operation for the A5 recording material will be described.

When sequential printing is performed on the recording material smaller than A4, as described above, the similar print operations as those for A4 can be performed.

Therefore, when printing is performed on the recording material smaller than A4 (A5 according to the present exemplary embodiment), the /TOP signal output timing (311, 321, 331,) and feeding operation starting timing (312, 322, 332) are the same as those for A4 sheet printing.

Thus, timing (413, 423, 433) when the A5 recording material fed at the feeding operation starting timing (312, 322, 332) reaches the registration sensor 40 is the same as the timing for the A4 recording material (313, 323, 333). Further, suspension (324, 334) at the suspension position and re-feeding timing (325, 335) are also the same. However, since the A5 recording material is smaller than the A4 recording material in size, timing (416, 426, 436) when the recording material passes through the registration sensor 40 during A5 sheet printing comes earlier than that during A4 sheet printing, and a sheet interval distance T2 is greater than that for A4 sheet printing (T2>T1).

As described above, the sheet interval distance T2 is larger during A5 sheet printing, however, the time T0 from stopping to restarting feeding is not different from that during A4 sheet printing. As described above, the sheet interval distance T2 is sufficient as far as it can ensure the time T1 when the recording material can be detected by the registration sensor 40. Therefore, if a spare time acquired by "T2−T1" can be used to increase the time T0 from stopping to restarting feeding, a conveyance margin for the delay of the conveyance of the recording material described above can be increased.

In consideration of the above described matters, according to the present exemplary embodiment, a method is discussed for increasing the conveyance margin for the delay of the conveyance of the recording material by using the sheet interval distance time (T2−T1), which is increased when printing is performed on the small-size recording material, for the time from stopping to restarting feeding.

Figure 6:
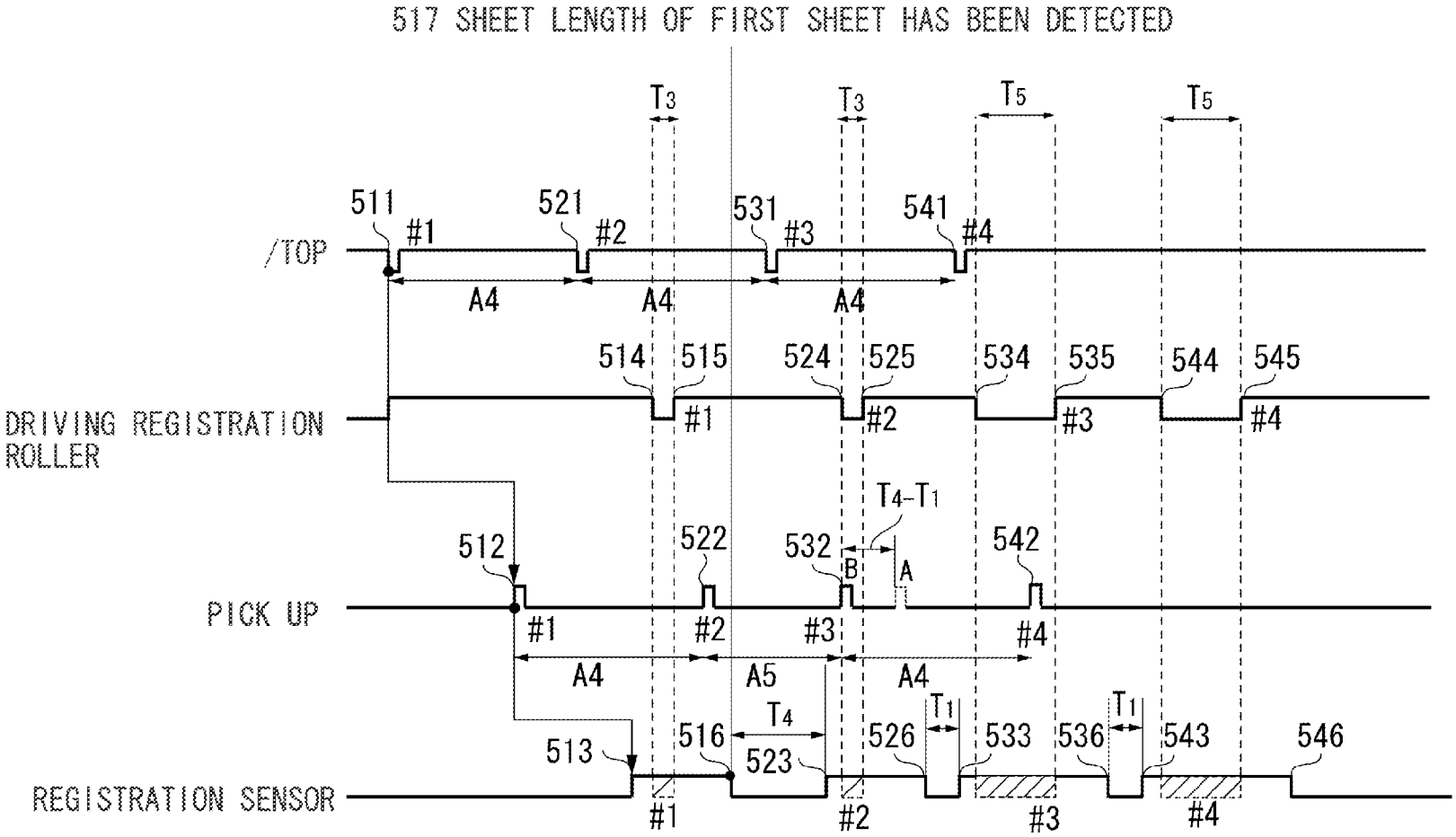
FIG. 6 is a timing chart for A5 sheet printing according to the first exemplary embodiment.

FIG. 6 is a timing chart for A5 sheet printing according to the present exemplary embodiment.

At timing 511, the engine control unit 202 outputs the /TOP signal for a first recording material (preceding recording material) and, at timing 521, outputs the /TOP signal for a subsequent recording material at the same interval as that for A4 sheet printing. After each /TOP signal is output at the timing 511, 521, and then at timing 512, 522, the engine control unit 202 starts the feeding operation at the same timing as that for A4 sheet printing.

Time interval (image forming interval) after the /TOP signal for the first recording material is output at the timing 511 and before the /TOP signal for the subsequent recording material is output at the timing 521 is previously stored. The image forming interval is previously stored corresponding to the size of the recording material.

The image forming apparatus according to the present exemplary embodiment is configured such that an image can be formed on the recording material (second recording material) of the smaller size (A5) than the size (A4) of the material (first recording material) corresponding to a minimum value of values previously stored as the image forming interval.

The engine control unit 202 defines the length (length of the recording material, length of sheet) of the first recording material in the conveyance direction based on the time after the leading edge of the first recording material reaches the registration sensor 40 at timing 513 before the trailing edge thereof has passed through the registration sensor 40 at timing 516. The engine control unit 202 and the registration sensor 40 constitute a detection unit.

If, when the /TOP signal is output, the length of the first recording material has been detected at timing 517, the engine control unit 202 determines the feeding starting timing based on the detection result. When the length of the first recording material has not been detected, the feeding operation is started at the same timing as that for A4 sheet printing.

According to the present exemplary embodiment, as illustrated in FIG. 6, since the timing when the length of the first recording material is detected comes after the /TOP signal for the second recording material is output, the feeding timing for the third and subsequent recording materials are set earlier.

A calculation equation for calculating the feeding timing based on the detection result is described as below, by defining the feeding timing before being changed as A and the feeding timing after being changed as B (refer to FIG. 6).

$$B=A-(T4-T1)$$

Since T1 refers to the time required to return the mechanical flag of the registration sensor 40 to an original position as described above, it is the securely required time at least. Thus, the feeding timing may be set earlier by difference acquired by extracting T1 from a current spare time T4.

By setting the feeding timing earlier, a period T5 after the recording material reaches the suspension position before re-feeding is started becomes longer than a period T3 during A4 sheet printing, and thus the conveyance margin can be increased.

Figure 7:
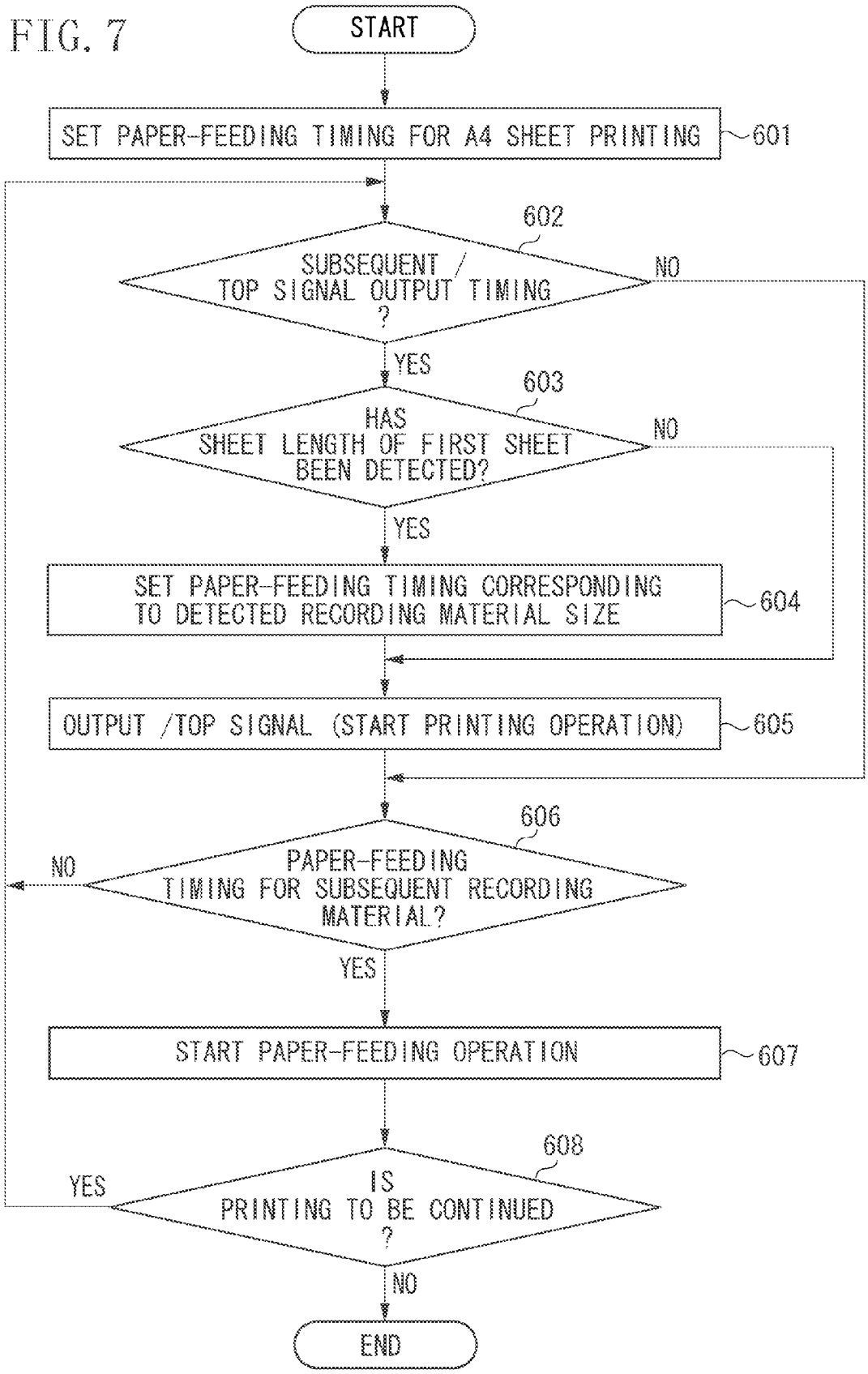
FIG. 7 is a flowchart illustrating control content of an engine control unit for printing according to the first exemplary embodiment.

FIG. 7 is a flowchart illustrating the control content of the engine control unit 202 for printing according to the present exemplary embodiment.

In step 601, when the print operation is started, the engine control unit 202 first sets the feeding timing to the timing for A4 sheet printing. Subsequently, the engine control unit 202 waits the /TOP output timing, and, when the /TOP output timing comes (YES in step 602), then in step 603, it is confirmed whether the length of the recording material has been detected. When the length of the recording material has not been detected (NO in step 603), then in step 605, the /TOP signal is output. When the set feeding timing (timing for A4 sheet printing) comes (YES in step 606), in step 607, the feeding operation is started.

On the other hand, at /TOP timing in step 602, when the length of the recording material has been detected (YES in step 603), after the feeding timing according to the detected recording material size is set in step 604, the /TOP signal is output in step 605. Subsequently, when the feeding timing corresponding to the detected length of the recording material comes (YES in step 606), then in step 607, the feeding is started.

In step 608, when printing is determined to be continued, the engine control unit 202 repeatedly performs the above-described operations.

As described above, the image forming apparatus according to the present exemplary embodiment is configured such that an image can be formed on the recording material in the smaller size (A5) than the size (A4) of the recording material corresponding to the minimum value of values previously stored as the image forming interval.

In the sequential printing performed on the recording material in the smaller size (A5), after the length of the recording material has been detected, the printing is performed at the image forming interval for A4 sheet printing and at the feeding timing according to the detection result (small size) of the length of the recording material.

In other words, for A5 sequential printing, a time after the /TOP signal is output before the pick-up roller 31 starts the feeding operation is set shorter than that for A4 sequential printing. Thus, a time after the pick-up roller 31 starts the feeding operation before the registration roller pair 33 starts the feeding operation becomes longer than that for A4 sequential printing. With this arrangement, feeding performance can be improved without decreasing the throughput. In other words, for smaller-size recording material printing, the feeding timing according to the recording material size is used to increase the margin for the conveyance of the recording material and the delay of the conveyance.

The exemplary embodiment of present invention can be desirably applied to the image forming apparatus for which a user can specify the size of the recording material. As described above, according to the present exemplary embodiment, since the actual size of the recording material to be printed is detected, even when the specified size and the size of the recording material to be printed are different from each other, the size of the material to be printed can be more accurately detected. Thus, printing can be performed at the feeding timing corresponding to the recording material to be printed.

Further, the exemplary embodiment of the present invention can be desirably applied even to the image forming apparatus for which a user can specify the size of the recording material and which is not provided with the unit for detecting the size of the recording material as described above. Furthermore, as the unit for detecting the recording material, the unit is not limited to the registration sensor 40 for detecting the size of the fed recording material as described above. The unit may detect the size of the recording material placed in the feeding cassette 104, for example.

Moreover, in the present exemplary embodiment, the image forming apparatus is described that adopts the intermediate transfer belt as the image bearing member and an intermediate transfer method for forming a color image (multicolor image) on the recording material by the primary transfer process and the secondary transfer process, however, the present invention is not limited thereto. For example, the image forming apparatus may be provided with a belt member for bearing and conveying the recording material, and employ a method, in the transfer process, for transferring the image onto the recording material borne and conveyed by the belt member. The image forming apparatus may adopt the photosensitive drum as the image bearing member and form a monochromatic image. In other words, as long as the image forming apparatus is provided with the re-feeding unit that can stop the recording material fed by the feeding unit and feed the recording material to the transfer unit in synchronization with the timing when the toner image formed on the image bearing member reaches the transfer unit, the exemplary embodiment of the present invention can be desirably applied.

A second exemplary embodiment will be described below.

According to the first exemplary embodiment described above, the roller having a circular-shaped sectional surface is used for the pick-up roller 31 of the feeding unit, and the recording material is conveyed and fed by the distance depending on the rotation amount of the roller. On the other hand, according to the present exemplary embodiment, a D-cut roller is used for the pick-up roller 31 and, in consideration of the number of rotations of the pick-up roller 31, the image forming interval and the feeding interval may be changed (set). A part of the outer peripheral surface of the D-cut roller (D roller) is cut off along a rotational axis direction, and the D-cut roller corresponds to the roller that feeds the recording material with its outer peripheral surface by rotation. According to the present exemplary embodiment, configuration different from that of the first exemplary embodiment will be described, and the configuration similar to that of the first exemplary embodiment will not be repeated.

FIGS. 8A, 8B, 8C and 8D are schematic diagrams illustrating a feeding mechanism provided for the image forming apparatus.

Figure 8A:
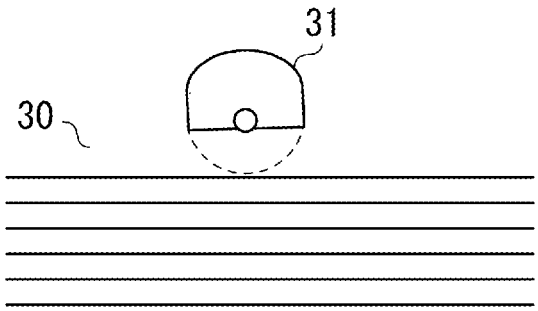
FIGS. 8A, 8B, 8C, and 8D are schematic diagrams illustrating a feeding mechanism provided for the image forming apparatus according to a second exemplary embodiment.
Figure 8B:
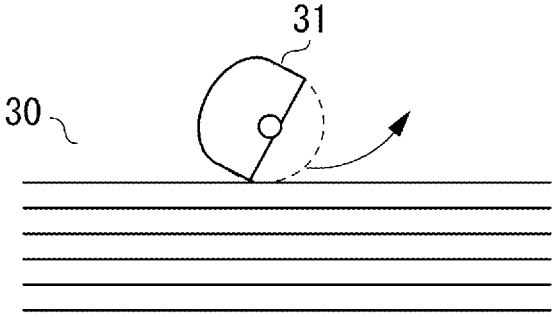

The difference between the feeding mechanisms according to the present exemplary embodiment and the first exemplary embodiment is in that the D-cut roller is used for the pick-up roller 31. As illustrated in FIG. 8B, the pick-up roller 31 is rotated once in a direction indicated by the arrow in the diagram to feed one piece of the A4 recording material 30. As described above, according to the present exemplary embodiment, the pick-up roller 31 is rotated once to convey the A4 recording material 30 by a predetermined distance, so that the feeding operation can be performed.

Figure 8C:
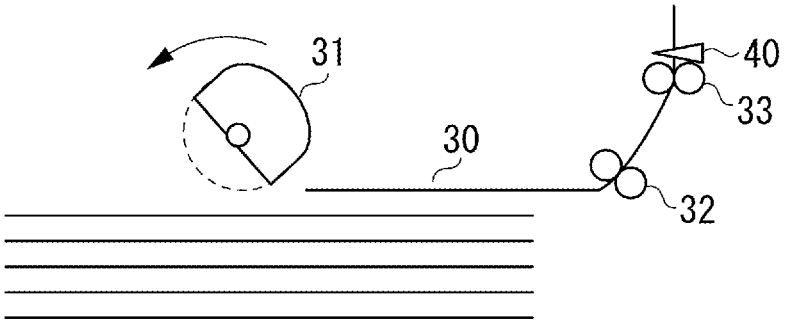

FIG. 8C is a schematic diagram illustrating a position of the recording material 30 when the feeding operation is normally performed. Along with one turn of the pick-up roller 31, the recording material 30 is conveyed by the conveyance roller pair 32 and the registration roller pair 33 to reach the registration sensor 40.

Figure 8D:
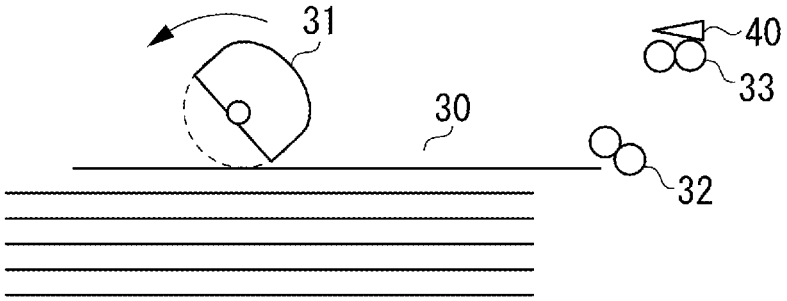

FIG. 8D is a schematic diagram illustrating a position of the recording material 30 when the recording material 30 cannot be conveyed by the predetermined distance due to the slip of the recording material 30 and the abrasion of the pick-up roller 31 while the recording material 30 is being fed. For example, when the smaller-size recording material such as envelop is fed and the pick-up roller 31 slips, the one rotation of the pick-up roller 31 may not be able to normally feed the recording material. In such a case, since the smaller-size recording material 30 has not reached the conveyance roller pair 32 (since the recording material 30 is not held by the roller pair), it is not be conveyed by the conveyance roller pair 32. Therefore, the pick-up roller 31 is required to rotate once again (referred to as "retry feeding", hereinafter).

According to the present exemplary embodiment, when the A4 recording material is fed, to improve the throughput, the one turn of the pick-up roller 31 causes the feeding operation. When the smaller-size recording material is fed, to securely perform the feeding operation of the recording material, the pick-up roller 31 is rotated two turns to retry the feeding.

Figure 9:
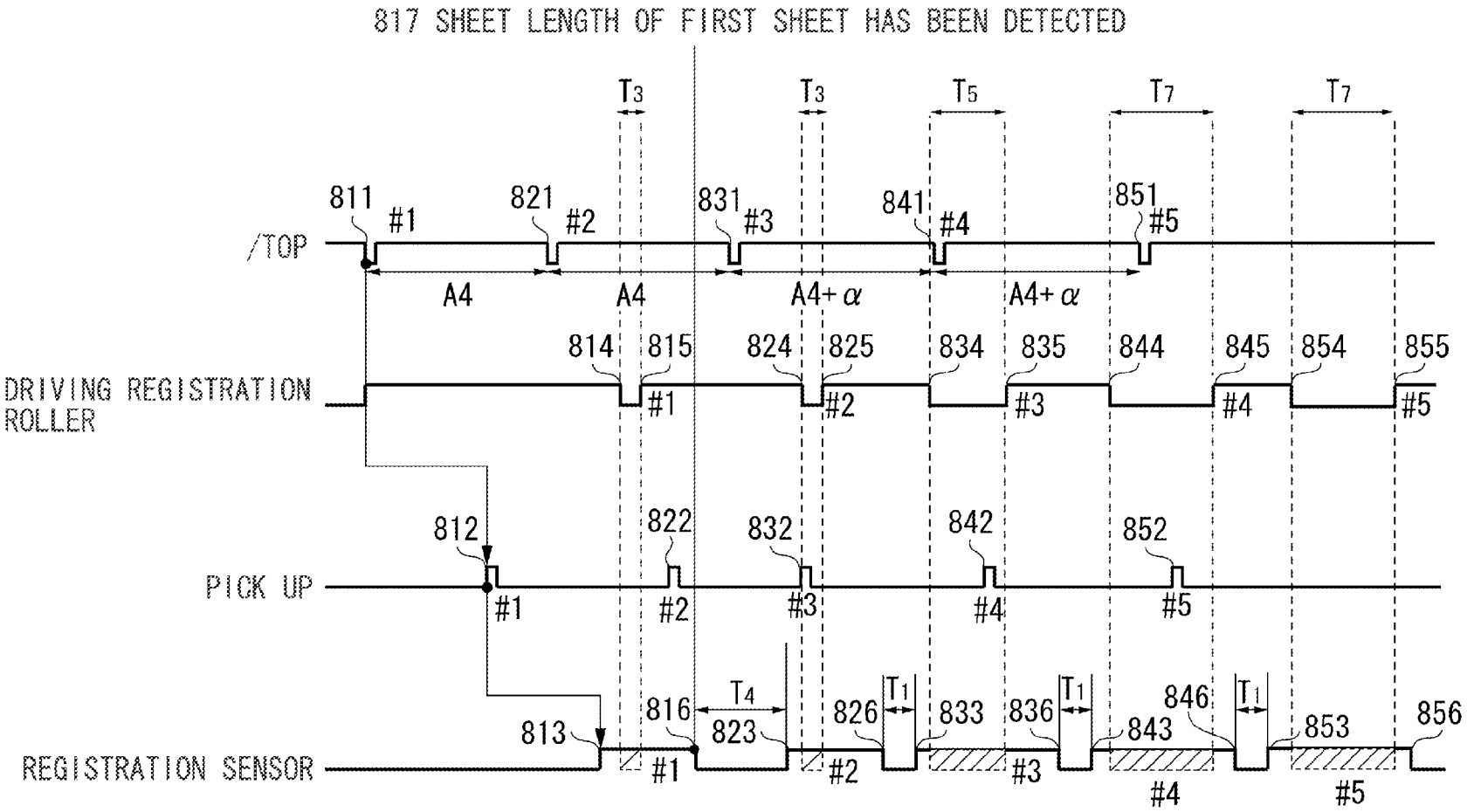
FIG. 9 is a timing chart for A5 sheet printing according to the second exemplary embodiment.

FIG. 9 is a timing chart for A5 sheet printing according to the present exemplary embodiment.

Since the control for detecting the length of the recording material is similar to that of the first exemplary embodiment illustrated in FIG. 6 (up to timing 817), it will not be repeatedly described.

If the length of the first recording material has been detected at the timing 817 when the /TOP signal has been output, the engine control unit determines the feeding starting timing based on the detected result of the length of the recording material and the feeding timing of timing 832 of the third and subsequent recording materials are changed to be earlier. Since the method for calculating the feeding timing is similar to that of the first exemplary embodiment, it is not repeatedly described.

At the same time, it is determined whether feeding retrial can be performed at the current /TOP signal output interval. When the feeding retrial cannot be performed, then at timing 831, 841, and 851, the /TOP signal output interval between a third and fourth (and fourth and fifth) recording material is increased by "α". A time required for the feeding retrial is defined as TRetry, and the determination of whether the feeding retrial can be performed is calculated as below.

$$T\text{Retry} < T5$$

The feeding retrial can be performed at the current /TOP signal output interval.

$$T5 < T\text{Retry}$$

The feeding retrial cannot be performed at the current /TOP signal output interval (not in time for the re-feeding timing).

Further, "α" can be calculated as below.

$$\alpha = T\text{Retry} - T5$$

According to the present exemplary embodiment, as the case where the feeding retrial cannot be performed at the /TOP signal output interval for A4 sheet printing, at the timing 841 and 851, the /TOP signal output timing is changed in the fourth and fifth recording materials. At the timing 841 and 851, the /TOP signal output timing is delayed by "α" to also delay the re-feeding timing by "α" at timing 845 and 855, so that the conveyance margin T7 can be set to be the time when the feeding retrial can be performed.

$$T7 = T5 + \alpha = T\text{Retry}$$

Therefore, since the feeding retrial operation can be performed for the fourth and subsequent recording materials, even when one feeding operation cannot normally feed the recording material, feeding can be performed again.

According to the present exemplary embodiment, TRetry is defined as a time required for one feeding retrial. However, in addition to the time required for the feeding retrial, TRetry may include the margin to have more spare time.

Figure 10:
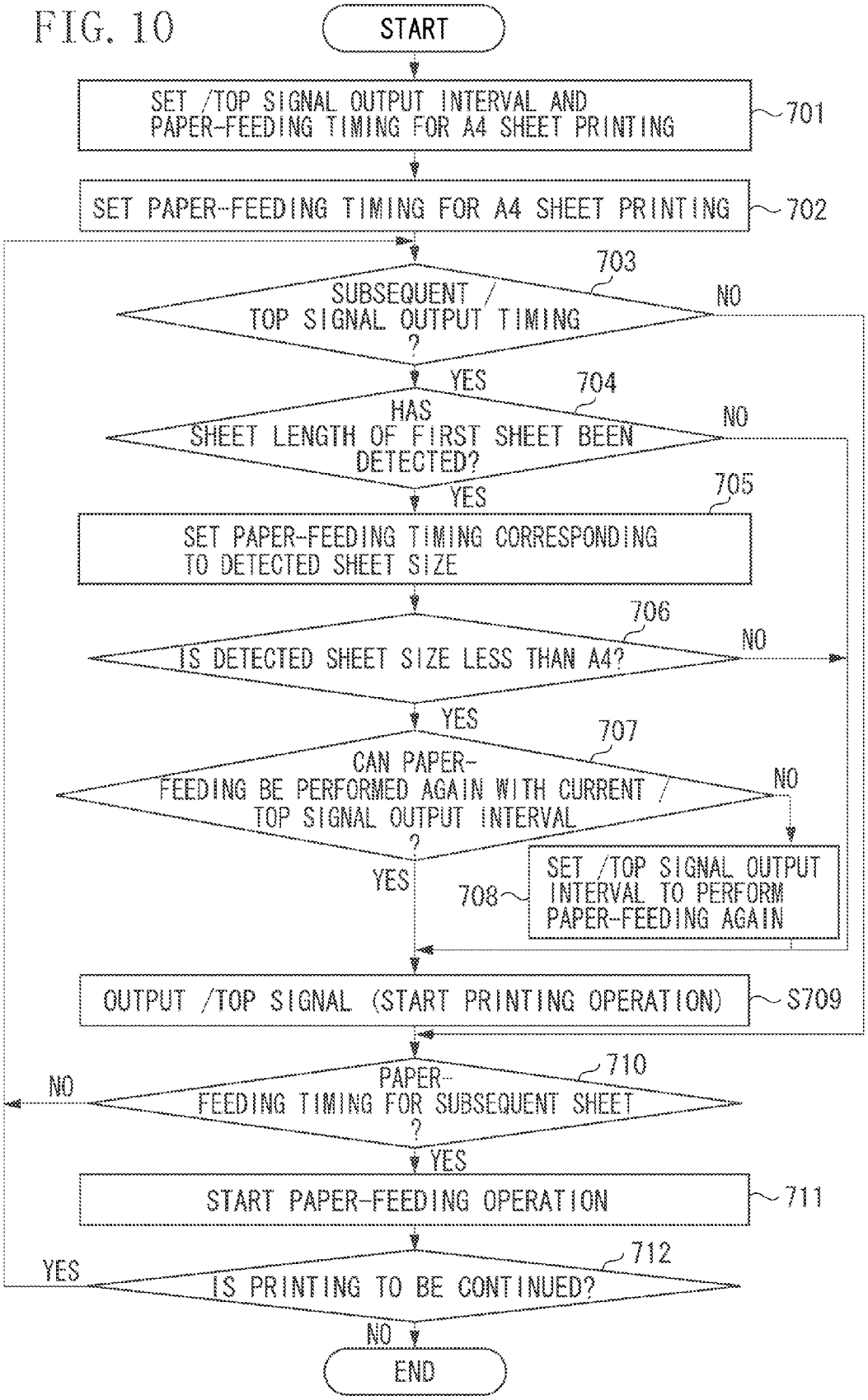
FIG. 10 is a flowchart illustrating control content of an engine control unit for printing according to the second exemplary embodiment.

FIG. 10 is a flowchart illustrating control content of the engine control unit 202 for printing according to the present exemplary embodiment.

When the smaller-size recording material is specified, in steps 701 and 702, the engine control unit 202 first sets the output interval of the /TOP signal and feeding timing for A4 sheet printing. Subsequently, the engine control unit 202 waits the /TOP output timing. When the /TOP output timing comes (YES in step 703), then in step 704, it is determined whether the length of the recording material has been detected. When the size of the recording material has not been defined (NO in step 704), in step 709, the /TOP signal is output. When the feeding timing set for the A4 recording material comes (YES in step 710), in step 711, the feeding operation is started.

On the other hand, at the /TOP output timing in step 703, when the length of the recording material has been detected (YES in step 704), then in step 705, the feeding timing is set according to the detected size of the recording material. Subsequently, when the size of the recording material is smaller than A4 (YES in step 706), then in step 707, it is determined whether the feeding retrial can be performed at the current /TOP signal output interval. When the size of the recording material is equal to or larger than A4 (NO in step 706), it is not determined whether the feeding retrial can be performed. In step 707, when NO is determined, in other words, the feeding retrial cannot be performed at the current /TOP signal output interval, in step 708, the /TOP signal output interval is increased to retry the feeding.

Subsequently, in step 709, the /TOP signal is output. When the feeding timing according to the detected size of the recording material comes in step 710, then in step 711, the feeding is started.

In step 712, when printing is determined to be continued (YES in step 712), the engine control unit 202 repeatedly performs the above-described operations.

As an example, it is determined whether the feeding can be retried based on whether the size of the recording material is smaller than A4, however, the size thereof is not limited thereto and the size thereof can be appropriately set. Further, it may be determined whether feeding can be retried not based on the size of the recording material.

As described above, according to the present exemplary embodiment, for printing on the smaller-size recording material, after the length of the recording material has been detected, the image forming interval and the feeding interval sufficient for retrying the feeding are set to improve feeding performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-185719 filed Aug. 24, 2012, which is hereby incorporated by reference herein in its entirety.

What is claimed is:

1. An image forming apparatus comprising:

an image forming unit configured to start forming an image on an image bearing member according to a reference signal;

a transfer unit configured to transfer the image, which is formed on the image bearing member by the image forming unit, onto a recording material at a transfer portion;

a feeding unit configured to feed the recording material;

a detection unit configured to detect a size of the recording material; and a control unit configured to output the reference signal at a time interval corresponding to a predetermined size recording material and control the feeding unit to feed the recording material at a timing of when a predetermined time has elapsed since the image forming unit started forming the image on the image bearing member, wherein, in a case where the size of the recording material detected by the detection unit is smaller than the predetermined size, the control unit refrains from changing the time interval to output the reference signal and controls the feeding unit to feed the recording material at a timing of when a time, that is shorter than the predetermined time, has elapsed since the image forming unit started forming the image on the image bearing member.

2. The image forming apparatus according to claim 1, further comprising a re-feeding unit configured to stop the recording material fed by the feeding unit and to re-feed the recording material to the transfer portion in synchronization with a timing of when the image formed on the image bearing member by the image forming unit reaches the transfer portion.

3. The image forming apparatus according to claim 1, further comprising a specification unit configured to allow a user to specify the predetermined size.

4. The image forming apparatus according to claim 1, wherein the detection unit is provided on a conveyance path for conveying the recording material and configured to detect a length of the recording material fed by the feeding unit in a conveyance direction.

5. The image forming apparatus according to claim 1, further comprising a placement unit configured to place the recording material thereon, wherein the feeding unit is configured to feed the recording material from the placement unit.

6. The image forming apparatus according to claim 1, wherein, in a case where the recording material is unable to be fed by the feeding unit, even if the control unit controls the feeding unit to feed the recording material at the timing of when the time, that is shorter than the predetermined time, has elapsed since the image forming unit started forming the image on the image bearing member, the control unit executes retry feeding of the recording material by the feeding unit.

7. The image forming apparatus according to claim 1, wherein the feeding unit includes a roller configured to feed a sheet of a recording material by a single turn of the roller, and wherein, in a case where the recording material is unable to be fed by the feeding unit, even if the control unit controls the feeding unit to feed the recording material at the timing of when the time, that is shorter than the predetermined time, has elapsed since the image forming unit started forming the image on the image bearing member, the control unit increases the time interval to output the reference signal to ensure a time for the roller to rotate one more time.

8. The image forming apparatus according to claim 1, wherein, after the detection unit detects that the size of the recording material is smaller than the predetermined size, compared with before the detection unit detects the size of the recording material, the control unit refrains from changing an interval from outputting the reference signal of an image corresponding to a first recording material to output the reference signal of an image corresponding to a second recording material which follows the first recording material, and controls the feeding unit to shorten a time interval from feeding of the first recording material to feeding of the second recording material.

9. The image forming apparatus according to claim 1, wherein the predetermined size is A4-size.

10. An image forming apparatus comprising:

an image forming unit configured to start forming an image on an image bearing member according to a reference signal;

a transfer unit configured to transfer the image, which is formed on the image bearing member by the image forming unit, onto a recording material at a transfer portion;

a feeding unit configured to feed the recording material;

a detection unit configured to detect a size of the recording material; and a control unit configured to output the reference signal at a time interval corresponding to a predetermined size recording material and control the feeding unit to feed the recording material at a timing of when a first time has elapsed since the image forming unit started forming the image on the image bearing member, wherein, in a case where the size of the recording material detected by the detection unit is smaller than the predetermined size, the control unit continues to output the reference signal at the time interval corresponding to the predetermined size recording material so that the image forming unit continues to start forming an image on the image bearing member at the unchanged time interval corresponding to the predetermined size recording material, and the control unit controls the feeding unit to feed the recording material at a timing of when a second time has elapsed since the image forming unit started forming the image on the image bearing member, wherein the first time is a predetermined time based on the predetermined size recording material and the second time is shorter than the first time.

* * * * *